United States Patent [19]

Hane et al.

[11] Patent Number: 5,004,648

[45] Date of Patent: Apr. 2, 1991

[54] FIBER OF A FLUOROCARBON POLYMER AND A PROCESS FOR PRODUCING THE SAME

[75] Inventors: Toshioki Hane, Suzuka; Shigeki Katayama, Yokohama, both of Japan

[73] Assignee: Asahi Kasei Kogyo Kabushiki Kaisha, Osaka, Japan

[21] Appl. No.: 236,926

[22] Filed: Aug. 26, 1988

[30] Foreign Application Priority Data

Aug. 26, 1987 [JP] Japan ..... 62-210336

[51] Int. Cl.[5] ..... D02G 3/00

[52] U.S. Cl. ..... 428/364; 428/224; 428/373; 428/397

[58] Field of Search ..... 428/359, 364, 397, 401, 428/373; 521/25, 30, 31, 33

[56] References Cited

U.S. PATENT DOCUMENTS 3,940,916 3/1976 Grot ..... 521/33

3,985,501 10/1976 Grot ..... 526/286

4,399,183 8/1983 Withers ..... 428/247

FOREIGN PATENT DOCUMENTS 6040459 2/1982 Japan .

*Primary Examiner*—Lorraine T. Kendell

*Attorney, Agent, or Firm*—Birch, Stewart, Kolasch & Birch

[57] ABSTRACT

There is disclosed a fiber of a fluorocarbon polymer having pendant ion exchange groups, the fiber having a tensile strength at break as high as at least 1.0 g/denier. The fiber can be produced by subjecting to hydrolysis or chemical modification treatment a filament of a fluorocarbon polymer having ion exchange precursor groups in melt-fabricatable form to convert the ion exchange precursor groups to ion exchange groups in melt-nonfabricatable form and subjecting the resultant heat-infusible filament to drawing.

4 Claims, No Drawings

FIBER OF A FLUOROCARBON POLYMER AND A PROCESS FOR PRODUCING THE SAME

BACKGROUND OF THE INVENTION

1. Field of the Invention

The present invention relates to a novel fiber of a fluorocarbon polymer and a process for producing the same. More particularly, the present invention is concerned with a novel fiber of a fluorocarbon polymer, which not only has ion exchange properties, swelling properties, shrinking properties, and resistance to heat and corrosion but also has high tensile strength at break and which, therefore, is useful for various applications such as recovery of heavy metals, detection of humidity change and measurement of salt concentration and can also be employed as a reinforcing material for films, membranes, etc. The present invention is also concerned with a process for producing such a fiber by preparing a filament from a fluorocarbon polymer having ion exchange precursor groups in melt-fabricatable form, converting the precursor groups of the polymer filament to ion exchange groups in melt-nonfabricatable form, and then drawing the resultant melt-nonfabricatable filament at a temperature within a specific range.

2. Discussion of Related Art

Fibers of a fluorocarbon polymer having ion exchange properties are known. For example, U.S. Pat. No. 3,985,501 discloses a fiber of a fluorinated polymer containing sulfonyl groups, and in this patent, it is described that the sulfonyl groups are in the form of sulfonamide groups, sulfonic acid groups or a salt thereof. Further, U.S. Pat. No. 3,940,916 discloses a woven or knitted fabric comprising filaments of a fluorinated polymer containing sulfonyl groups, the filaments having a size of not larger than 400 denier and being individually supported by a high strength reinforcing material.

As disclosed in the above-mentioned patents, in general, a fiber having ion exchange properties is produced from a thermoplastic polymer containing ion exchange precursor groups using a customary melt spinning technique. The customary melt spinning technique includes drawing a spun filament in which the spun filament is generally drawn by 50 to 400%. However, even by such drawing, the strength of the filament cannot be satisfactorily improved and, therefore, it is difficult to perform fabrication, for example, weaving of the filament without occurrence of breaks of the filament. Therefore, as disclosed in U.S. Pat. No. 3,940,916, it is inevitable that the filaments are supported by a high strength reinforcing material. The use of a supporting high strength reinforcing material is disadvantageous because the need for such reinforcing material is only temporary for performing the weaving operation and the reinforcing material does not contribute to the function of the resultant woven fabric. In addition, the use of reinforcing material disadvantageously causes the weaving operation to be cumbersome.

Further, Japanese Patent Application Publication No. 60-40459 discloses an ion exchange membrane reinforced by a woven fabric obtained by weaving a fiber having ion exchange groups and another fiber having no ion exchange groups. The above-mentioned Patent Application Publication contains no description about the process for producing the fiber having ion exchange groups and, therefore, it is considered that a customary melt spinning technique is employed, which means that this prior art fiber also has the same problem with respect to the strength as mentioned above.

SUMMARY OF THE INVENTION

When a fiber of a fluorocarbon polymer having ion exchange groups is employed particularly in the form of a woven fabric or a knitted fabric, it is extremely important from a practical viewpoint that the fiber have a strength as high as possible.

The present inventors have made extensive and intensive studies with a view toward developing a fiber of a fluorocarbon polymer having a high strength. As a result, it has surprisingly been found that a high strength fiber can be obtained by subjecting a fiber in melt-nonfabricatable form to a high degree of drawing. The present invention has been accomplished on the basis of this novel finding.

Therefore, it is an object of a the present invention to provide a novel fiber of a fluorocarbon polymer, which not only has ion exchange properties, swelling properties, shrinking properties, and resistance to heat and corrosion but also has high tensile strength at break and which is useful for various applications such as recovery of heavy metals, detection of humidity change and measurement of salt concentration and can also be employed as a reinforcing material for films, membranes, etc.

It is another object of the present invention to provide a novel process for producing a fiber of a fluorocarbon polymer having the above characteristics.

The foregoing and other objects, features and advantages of the present invention will be apparent from the following detailed description and appended claims.

DETAILED DESCRIPTION OF THE INVENTION

In one aspect of the present invention, there is provided a fiber of a fluorocarbon polymer having pendant groups represented by at least one formula selected from the group consisting of:

$$-SO_3X \text{ and } -CO_2X$$

wherein X is at least one member selected from the group consisting of H, $NH_4$, an alkali metal and an alkaline earth metal, the fiber having a tensile strength at break of at least 1.0 g/denier.

"Denier" as used herein is intended to mean the fiber weight (g) per 9,000 m of the fiber as measured on a dry basis. "Tensile strength at break" as used herein means that as measured at 25 ° C., a relative humidity of 50% and a rate of deformation of 200%/min.

The fiber of a fluorocarbon polymer of the present invention has a tensile strength at break of at least 1.0 g/denier, preferably 1.3 g/denier. A conventional fiber of a fluorocarbon polymer containing ion exchange groups, which is obtained by drawing a spun filament having ion exchange precursor groups in melt-fabricatable form, and converting the ion exchange precursor groups of the polymer filament to ion exchange groups in melt-nonfabricatable form, has a tensile strength at break of only 0.2 g/denier to 0.6 g/denier. It is quite surprising that the present invention can attain a fiber having a tensile strength at break of as high as 1.0 g/denier, preferably 1.3 g/denier.

The extremely strong fiber of the present invention can be produced by a novel process in which a filament obtained by spinning a fluorocarbon polymer having ion exchange precursor groups in melt-fabricatable form, is hydrolyzed or chemically modified to convert the ion exchange precursor groups in melt-fabricatable form to ion exchange groups in melt-nonfabricatable form and the resultant filament is then subjected to drawing.

Accordingly, in another aspect of the present invention, there is provided a process for preparing a fiber of a fluorocarbon polymer, which comprises the steps of:

(1) providing a filament of a fluorocarbon polymer having pendant groups represented by at least one formula selected from the group consisting of:

$$-SO_3X \text{ and } -CO_2X$$

wherein X is at least one member selected from the group consisting of H, $NH_4$, an alkali metal and an alkaline earth metal, and (2) drawing the filament at a temperature of at least 100° C. but less than the decomposition temperature of the pendant groups, thereby obtaining a fiber of the fluorocarbon polymer which fiber has a tensile strength at break of at least 1.0 g/denier.

A fluorocarbon polymer having ion exchange precursor groups which is to be subjected to spinning for forming a filament, is a copolymer of at least one monomer selected from fluorinated olefins represented by the formula:

$$CF_2{=}CFY \quad (1)$$

wherein Y is F, Cl, $CF_3$ or H, and at least one monomer selected from fluorovinyl ethers represented by the formula:

$$CF_2{=}CFO(CF_2CFY'O)_m(CF_2)_nY'' \quad (2)$$

wherein Y' is F, Cl or $CF_3$; Y'' is $SO_3X'$ or $CO_2X''$ in which X' is F or Cl and X'' is an alkyl group having 1 to 5 carbon atoms; m is an integer of 0 to 2; and n is an integer of 1 to 5.

In order to improve the melt-fabricatable properties of the copolymer and the strength of the ultimate fiber, the above-mentioned copolymer may be incorporated with a fluorinated vinylether represented by the formula:

$$CF_2{=}CFO(CF_2CFY'O)_{m'}(CF_2)_{n'}CF_3 \quad (3)$$

wherein Y' is as defined above; m' is an integer of 0 to 2; and n, is an integer of 0 to 2.

In the above-mentioned formulae, it is preferable that Y be F and Y' be $CF_3$.

Representative examples of fluorinated vinylethers represented by formula (2) include $$CF_2{=}CFO(CF_2)_{2-3}SO_2F,$$

$$CF_2{=}CFOCF_2CF(CF_3)O(CF_2)_{2-3}SO_2F,$$

$$CF_2{=}CFO(CF_2)_{2-4}CO_2CH_3, \text{ and}$$

$$CF_2{=}CFOCF_2CF(CF_3)O(CF_2)_{2-4}CO_2CH_3.$$

Representative examples of fluorinated vinylethers represented by formula (3) include $$CF_2{=}CFOCF_3,$$

$$CF_2{=}CFOC_2F_5,$$

$$CF_2{=}CFOC_3F_7, \text{ and}$$

$$CF_2{=}CFO[CF_2CF(CF_3)O](CF_2)_{0-2}CF_3.$$

The above-mentioned fluorocarbon polymer can be obtained by polymerization of at least one of fluorinated olefins of formula (1) with at least one fluorinated vinylether of formula (2) containing ion exchange precursor groups, using a customary polymerization technique such as bulk polymerization, solution polymerization, emulsion polymerization and suspension polymerization.

The proportion of the compound of formula (2) in the copolymer to be used in the present invention is not particularly limited and is appropriately controlled according to the desired spinnability and drawability of the copolymer and the desired strength and use of the ultimate fiber. In general, the proportion of the compound of formula (2) is such that the value of EW of the copolymer is 800 to 2000, preferably 900 to 1800. "EW" as used herein means equivalent weight which is the weight (g) of the copolymer per equivalent of the compound of formula (2).

The above-mentioned copolymer having ion exchange precursor groups is subjected to melt spinning to obtain a filament. The melt spinning is effected at a temperature higher than the melting point of the copolymer but lower than the decomposition temperature thereof, generally 230° to 310 ° C., preferably 250° to 330 ° C. In the melt spinning, occurrence of melt fracture should be prevented by controlling the shear rate in an appropriate range. In this connection, the shear rate is preferably not more than 30 $sec^{-1}$. The other spinning conditions may be those conventionally employed in melt spinning.

Preferred examples of the above-mentioned copolymer having ion exchange precursor groups in melt-fabricatable form include a copolymer of tetrafluoroethylene and a vinyl ether having sulfonyl fluoride groups, a copolymer of tetrafluoroethylene and a vinyl ether having carboxylic acid ester groups, a mixture of the two copolymers, and a terpolymer of tetrafluoroethylene, a vinyl ether having sufonyl fluoride groups and a vinyl ether having carboxylic acid ester groups.

These copolymers are extruded through a spinneret with a single orifice or a plurality of orifices or a spinneret having concentrically arranged annular orifices for producing conjugated filaments, to form a filament.

The filament thus obtained is subjected to hydrolysis or chemical modification treatment prior to drawing, to convert the ion exchange precursor groups in melt-fabricatable form to ion exchange groups in melt-nonfabricatable form, and then subjected to drawing. The ion exchange groups in a melt-nonfabricatable form are generally selected from sulfonic acid groups and salts thereof and carboxylic acid groups and salts thereof. Of these, sulfonic acid groups and carboxylic acid groups are preferred. It is possible to draw the filament having ion exchange groups of acid type and then covert the acid type groups to salt type groups by salt exchange, and vice versa. It is also possible to draw the filament having ion exchange groups which are partly of acid type and partly of salt type. In this case, the proportions of the acid and salt are not limited.

Conventionally, it has been considered that drawing of a polymer filament is possible only when the polymer is in melt-fabricatable from, i.e., in heat fusible form. In view of this, it is surprising that a polymer filament in melt-nonfabricatable, i.e., in heat infusible form, has successfully been drawn without occurrence of breakage of the filament.

The drawing temperature is at least 100° C. but less than the decomposition temperature of the pendant ion exchange groups. Within this range, the most suitable drawing temperature should be selected depending on the type of ion exchange groups, i.e. depending on whether the ion exchange groups are of acid type or salt type. The type of ion exchange groups of a polymer is considered to have a close connection with the glass transition temperature of the polymer, and it is preferred to effect drawing of the polymer at a temperature close to the glass transition temperature of a portion of the polymer which comprises mainly the pendant chains and also comprises part of the main chain. When the ion exchange groups are of acid type, the drawing temperature is generally 100° to 250° C., preferably 120° to 220 ° C. On the other hand, when the ion exchange groups are of salt type, the drawing temperature is generally at least 110 ° C. but less than the decomposition temperature of the pendant groups, preferably 115° to 280 ° C.

Prior to drawing, the water content of the filament is preferably controlled to as low a level as possible. Generally, the filament is subjected to drying before drawing.

The draw ratio varies depending on the drawing temperature, but is at least 480%, preferably at least 500%. When the draw ratio is less than 480%, increase in the strength of the filament cannot be expected. The upper limit of the draw ratio is not limited as long as the filament can be stably drawn without occurrence of breakage of the filament. In the present invention, the term "draw ratio" is defind by the following formula $$\text{Draw ratio} = \frac{L_2}{L_1} \times 100\ (\%)$$

wherein $L_1$ is the original length of a filament before drawing and $L_2$ is the length of the filament after drawing.

The drawing speed is at least 500%/min, preferably at least 1000%/min. In the present invention, the drawing speed (V) is defined as follows.

$$V=(V_2-V_1)\times 100/D\ (\%/\text{min})$$

wherein when the filament is drawn between the feed point A and the take-up point B, $V_1$ is the feed rate (m/min) at the feed point A, $V_2$ is the take-up rate (m/min) at the take-up point B and D is the distance (m) between the points A and B.

The draw ratio and the drawing speed greatly affect the strength of the resultant fiber.

The fluorocarbon polymer fiber according to the present invention has high strength as compared to conventional fluorocarbon polymer fibers. The reason has not yet been fully elucidated, but is believed to reside in that the fiber of the present invention has been subjected to drawing with the pendant groups being in a melt-nonfabricatable form and, therefore, has a higher degree of orientation than conventional fibers which have been subjected to drawing with the pendant groups being in a melt-fabricatable form.

The size of the fiber of the present invention is not particularly limited and is generally in the range of 50 to 1000 denier, preferably 100 to 800 denier.

The fiber of the present invention may be either of a monofilament type or of a multifilament type. A multifilament generally consists of monofilaments having a size of not less than 5 denier.

The fiber of the present invention may have a cross-section of any shape, for example, a cross-section of a circular or elliptic shape or its modified shape.

The fiber of the present invention has pendant ion exchange groups of the formula $-SO_3X$ wherein X is as defined above and/or the formula $-CO_2X$ wherein X is as defined above. There are various types of fibers with respect to the type of ion exchange groups contained in the fiber and with respect to the manner in which the ion exchange groups are disposed in the fiber. For example, there may be a monofilament fiber which contains only ion exchange groups of formula $-SO_3X$, a monofilament fiber which contains only ion exchange groups of formula $-CO_2X$ and a monofilament fiber which contains both types of ion exchange groups of formulae $-SO_3X$ and $-CO_2X$. In a special case of the last fiber, there may be a complex monofilament fiber consisting of a core portion containing only ion exchange groups of formula $-SO_3X$ and a sheath portion containing only ion exchange groups of formula $-CO_2X$, and vice versa. Further, there may be a fiber consisting of multifilaments made of various combinations of monofilaments as mentioned above. When a fiber contains both ion exchange groups of formula $-SO_3X$ and ion exchange groups of formula $-CO_2X$, the proportions of the two types of ion exchange groups are not particularly limited.

The fiber of the present invention absorbs or releases water so that the dimensional changes of the fiber occur precisely in accordance with the changes in the humidity. It is also noted that the fiber of the present invention shrinks in an alkaline solution depending on the alkali concentration of the solution. Further, the fiber of a fluorocarbon polymer of the present invention has excellent properties which are well known to be inherent in a fluoropolymer, such as heat resistance and corrosion resistance. Moreover, the fiber of a fluorocarbon polymer according to the present invention has such high strength that it can safely be woven or knitted without a need for reinforcing material, thus overcoming the extreme difficulties encountered when attempting to weave or knit conventional fibers of a fluorocarbon polymer without using any reinforcing material. Therefore, the fiber of the present invention can be woven or knitted by various conventional techniques to obtain various types of ion exchange fabrics suitable for a wide variety of applications including adsorption and recovery of heavy metals such as zinc, iron and cadmium, adsorption of surface active agents, adsorption of proteins, recovery of acids, purification of basic gases, use as a carrier for supporting oxygen, purification of water, use as an acid catalyst, use as a filter medium, detection of salt concentration and measurement of humidity.

DETAILED DESCRIPTION OF PREFERRED EMBODIMENTS

The present invention will now be described in more detail with reference to the following Examples and Comparative Examples, which should not be construed as limiting the scope of the present invention.

In the following Examples and Comparative Examples, tensile strength at break of either a filament or a fiber is measured at 25° C. in an atmosphere having a relative humidity of 50% at a deformation rate of 200%/min.

EXAMPLE 1

A copolymer of tetrafluoroethylene and perfluoro-4,7-dioxa-5-methyl-8-nonenesulfonylfluoride having an equivalent weight (EW) of 1080 is extruded through one spinning nozzle at 280° C. at a linear feed rate of 0.9 m/min. at a shear rate of 22.6 $sec^{-1}$ and at a take-up speed of 50 m/min, to thereby prepare a single filament (hereinafter referred to as "filament A"). Filament A has a size of 800 denier and a tensile strength at break of 0.21 g/denier.

Filament A is immersed in a solution of 6N potassium hydroxide/methanol(1:1 in volume) at 72 ° C. for 20 hours to effect hydrolysis of the functional groups and then washed with water. The resultant filament is referred to as "filament B".

Filament B is immersed in an aqueous 1N hydrochloric acid solution at 60 ° C. for 20 hours to prepare a filament of a copolymer having pendant sulfonic acid groups. The filament is referred to as "filament C".

Filament C is dried at 50 ° C. in vacuo for a whole day and night and then drawn in a box-shaped heating oven at 180 ° C. at a drawing speed of 1100%/min. so that the draw ratio becomes 615%. The tensile strength at break of the resultant drawn filament is found to be 1.5 g/denier.

The drawn filament is immersed in an aqueous 1N potassium hydroxide solution at 60 ° C. for 20 hours to convert the sulfonic acid groups into potassium sulfonate groups and then dried at 50 ° C. for a whole day and night. The resultant fiber has a tensile strength at break of 1.7 g/denier.

EXAMPLE 2

A copolymer of tetrafluoroethylene and perfluoro-4,7-dioxa-5-methyl-8-nonenesulfonylfluoride having an EW of 1490 is extruded through one spinning nozzle at 300° C. at a linear feed rate of 0.9 m/min. at a shear rate of 22 $sec^{-1}$ and at a take-up speed of 50 m/min, to thereby prepare a single filament (hereinafter referred to as "filament A'"). Filament A' has a size of 850 denier and a tensile strength at break of 0.19 g/denier.

Filament A' is subjected to hydrolysis and to treatment with an aqueous 1N hydrochloric acid solution in substantially the same manner as in Example 1 to prepare a filament of a copolymer having pendant sulfonic acid groups. The filament is referred to as "filament C'".

Filament C' is dried at 50 ° C. in vacuo for a whole day and night and then drawn using the same apparatus as used in Example 1 at 200 ° C. at a drawing speed of 1200%/min so that the draw ratio becomes 550%. The resultant drawn filament has a tensile strength at break of 1.4 g/denier.

The drawn filament is treated with an aqueous 1N potassium hydroxide solution to convert the sulfonic acid groups into potassium sulfonate groups and then dried in substantially the same manner as in Example 1. The resultant fiber has a tensile strength at break of 1.6 g/denier.

EXAMPLE 3

Substantially the same procedure as in Example 1 is repeated except that 6N sodium hydroxide and 1N sodium hydroxide are used instead of 6N potassium hydroxide and 1N potassium hydroxide, respectively. Substantially the same results as in Example 1 are obtained.

COMPARATIVE EXAMPLE 1

Filament A is drawn using the same apparatus as used in Example 1 at 90 ° C. at a drawing seed of 1000%/min. so that the draw ratio becomes 350%. The resultant drawn filament has a tensile strength at break of 0.6 g/denier. The drawn filament is immersed in a solution of 6N potassium hydroxide/methanol (1:1 in volume) at 72 ° C. for 20 hours to effect hydrolysis. Then, the resultant filament is washed with water and dried. The thus obtained fiber has a tensile strength of 0.7 g/denier.

COMPARATIVE EXAMPLE 2

Filament A' is drawn using the same apparatus as used in Example 1 at 130 ° C. at a drawing speed of 1000%/min. so that the draw ratio becomes 330%. The resultant drawn filament has a tensile strength of 0.5 g/denier.

The drawn filament is converted into a filament of a copolymer having pendant potassium sulfonate groups in substantially the same manner as in Comparative Example 1. The resultant fiber has a tensile strength at break of 0.6 g/denier.

APPLICATION EXAMPLE 1

Using the drawn filament of a copolymer having pendant potassium sulfonate groups prepared in Example 1, a plain woven fabric is prepared at a warp count per inch of 50 and a weft count per inch of 50 by means of a shuttle-type loom.

Frequency of the warp breakage during the operation from warping to the completion of weaving is 0.0 times/$m^2$. Frequency of the weft breakage during the operation from winding on a tube to the completion of weaving is 0.01 times/$m^2$.

As apparent from the results, there is no substantial trouble in weaving due to thread breakage in the preparation of a plain woven fabric.

COMPARATIVE EXAMPLE 3

Using the drawn filament prepared in Comparative Example 1 which is not yet subjected to the hydrolysis, a plain woven fabric is prepared in substantially the same manner as in Application Example 1.

Frequency of the warp breakage during the operation from warping to the completion of weaving is 25 times/$m^2$. Frequency of the weft breakage during the operation from winding on a tube to the completion of weaving is 201 times/$m^2$.

As apparent from the results, it is practically impossible to prepare a plain woven fabric on a commercial scale.

APPLICATION EXAMPLE 2

The drawn filament of a copolymer having pendant potassium sulfonate groups prepared in Example 2 is immersed in each of aqueous sodium hydroxide solutions having the sodium hydroxide concentration indicated in Table 1 at 25° C. for 30 minutes to measure dimensional change of the filament.

The dimensional change is calculated in accordance with the following formula:

$$\text{dimensional change} = \frac{\text{dimension after immersion} - \text{original dimension}}{\text{original dimension}} \times 100$$

The results are shown in Table 1.

TABLE 1

| | | | | | |
|---|---|---|---|---|---|
| sodium hydroxide concentration (wt. %) | 0.0 | 6.0 | 12.5 | 25.1 | 30.2 |
| dimensional change | 0.0 | −0.28 | −0.61 | −1.18 | −1.49 |

TABLE 1-continued

| (%) |
|---|

The degree of the dimensional change of the fiber reflects the sodium hydroxide concentration of the aqueous sodium hydroxide solution, and vice versa. Therefore, it is possible to know the sodium hydroxide concentration of the solution from the dimensional change of the fiber by utilizing the above results showing the relationship between the dimensional change of the fiber and the sodium hydroxide concentration of the solution.

APPLICATION EXAMPLE 3

The drawn filament of a copolymer having pendant sulfonic acid groups prepared in Example 1 is dried in vacuo at 50° C. for a whole day and night. The dry drawn filament is exposed to an atmosphere having the relative humidity as shown in Table 2 at 25° C. for 30 minutes to measure dimensional change of the filament.

The dimensional change is calculated in accordance with the following formula:

$$\text{dimensional change} = \frac{\text{dimension after exposure} - \text{original dimension}}{\text{original dimension}} \times 100$$

The results are shown in Table 2.

TABLE 2

| | | | | |
|---|---|---|---|---|
| relative humidity (%) | 20.5 | 40.8 | 79.5 | 100 |
| dimensional change (%) | 0.0 | +0.39 | +0.83 | +1.05 |

The degree of the dimensional change of the fiber reflects the relative humidity, and vice versa. Therefore, it is possible to know the relative humidity of the atmosphere from the dimensional change of the fiber by utilizing the above results.

EXAMPLE 4

Filament C prepared in Example 2 which is the filament of a copolymer having pendant sulfonic acid groups is immersed in an acidic potassium chloride solution prepare by mixing an aqueous 0.1N potassium hydroxide solution and an aqueous 1.4N hydrochloric acid solution at room temperature for 10 hours to prepare a filament of a copolymer having both of pendant sulfonic acid groups and pendant potassium sulfonate groups. The thus prepared filament is dried at 50° C. for a whole day and night and then drawn using the same apparatus as used in Example 1 at 200° C. at a drawing speed of 1200%/min. so that the draw ratio becomes 520%. The tensile strength at break of the resultant drawn filament is 1.4 g/denier.

What is claimed is:

1. A fiber of a fluorocarbon polymer having pendant groups represented by at least one formula selected from the group consisting of:

$$-SO_3X \text{ and } -CO_2X$$

wherein X is at least one member selected from the group consisting of H, $NH_4$, an alkali metal and an alkaline earth metal, said fiber having a tensile strength at break of at least 1.0 g/denier.

2. The fiber according to claim 1, wherein said fluorocarbon polymer is a perfluorocarbon polymer.

3. The fiber according to any one of claims 1 and 2, which has a tensile strength at break of at least 1.3 g/denier.

4. The fiber according to claim 1, wherein said pendant groups are represented by formula $-SO_3X$ in which X is as defined in claim 1.

* * * * *